US008719984B2

(12) United States Patent
Miller, Jr.

(10) Patent No.: US 8,719,984 B2
(45) Date of Patent: May 13, 2014

(54) SEGMENTED AIR FOAM MATTRESS

(75) Inventor: Craig Salvatore Miller, Jr., Corona, CA (US)

(73) Assignee: Sizewise Rentals, L.L.C., Kansas City, MO (US)

( * ) Notice: Subject to any disclaimer, the term of this patent is extended or adjusted under 35 U.S.C. 154(b) by 412 days.

(21) Appl. No.: 12/897,746

(22) Filed: Oct. 4, 2010

(65) Prior Publication Data

US 2011/0239373 A1 Oct. 6, 2011

Related U.S. Application Data

(60) Provisional application No. 61/248,119, filed on Oct. 2, 2009.

(51) Int. Cl.
*A47C 27/10* (2006.01)

(52) U.S. Cl.
USPC ..... 5/710; 5/706; 5/711; 5/712; 5/713

(58) Field of Classification Search
USPC ..... 5/706, 710, 711, 712, 713, 726, 738
See application file for complete search history.

(56) References Cited

U.S. PATENT DOCUMENTS

| | | | | | |
|---|---|---|---|---|---|
| 787,137 | A | * | 4/1905 | Webb | 5/712 |
| 2,777,490 | A | * | 1/1957 | Munk | 383/66 |
| 2,874,826 | A | | 2/1959 | Matthews | |
| 3,653,083 | A | | 4/1972 | Lapidus | |
| 4,347,633 | A | | 9/1982 | Gammons | |
| 4,485,505 | A | | 12/1984 | Paul | |
| 4,686,722 | A | * | 8/1987 | Swart | 5/713 |
| 4,803,744 | A | | 2/1989 | Peck | |
| 4,821,354 | A | * | 4/1989 | Little | 5/422 |
| 4,947,500 | A | | 8/1990 | Seiler | |
| 5,070,560 | A | | 12/1991 | Wilkinson | |
| 5,323,500 | A | * | 6/1994 | Roe et al. | 5/710 |
| 5,388,292 | A | * | 2/1995 | Stinson et al. | 5/682 |
| 5,412,821 | A | | 5/1995 | Wilkinson | |
| 5,487,196 | A | | 1/1996 | Wilkinson | |
| 5,687,438 | A | | 11/1997 | Biggie | |
| 5,692,256 | A | | 12/1997 | Kramer | |
| 5,699,570 | A | | 12/1997 | Wilkinson | |
| 5,926,884 | A | | 7/1999 | Biggie | |
| 5,991,949 | A | * | 11/1999 | Miller et al. | 5/710 |
| 6,108,835 | A | * | 8/2000 | Hwang | 5/420 |

(Continued)

FOREIGN PATENT DOCUMENTS

JP 405285029 11/1993

OTHER PUBLICATIONS

Hill-Rom; VersaCare Bed System Surfaces; 4 pages.

*Primary Examiner* — Robert G Santos
*Assistant Examiner* — Myles Throop
(74) *Attorney, Agent, or Firm* — Spencer Fane Britt Browne LLP

(57) ABSTRACT

An air foam mattress system includes a foam top component, and a foundation component including a plurality of segmented, individually wrapped, inflatable air cells allowing for a plurality of pivot points, a segmented perimeter, and individual pressure adjustment of the segments for maximum patient comfort in all articulated bed positions. In an embodiment, the air cell contains a u-shaped insert providing segmented perimeter sections integral to the air cell. In another embodiment, the air cell contains a trapezoidal shaped insert with multiple segments having different degrees of foam stiffness.

8 Claims, 7 Drawing Sheets

(56) References Cited

U.S. PATENT DOCUMENTS

| | | | | |
|---|---|---|---|---|
| 6,223,369 | B1 | 5/2001 | Maier | |
| 6,269,505 | B1 | 8/2001 | Wilkinson | |
| 6,370,716 | B1 | 4/2002 | Wilkinson | |
| 6,782,574 | B2 | 8/2004 | Totton | |
| 6,826,795 | B2 * | 12/2004 | Wilkinson | 5/713 |
| 6,839,929 | B2 * | 1/2005 | Stolpmann | 5/710 |
| 6,848,138 | B1 | 2/2005 | Maier | |
| 7,296,314 | B2 * | 11/2007 | Wyatt et al. | 5/713 |
| 8,122,545 | B2 * | 2/2012 | Wilkinson | 5/713 |
| 8,397,325 | B2 * | 3/2013 | Satou et al. | 5/654 |
| 2002/0129448 | A1 * | 9/2002 | Pirzada | 5/713 |
| 2003/0208849 | A1 * | 11/2003 | Wilkinson | 5/713 |
| 2007/0151033 | A1 | 7/2007 | Wyatt | |
| 2008/0155755 | A1 * | 7/2008 | Crousore et al. | 5/706 |
| 2012/0272456 | A1 * | 11/2012 | Lemmer | 5/710 |

* cited by examiner

SEGMENTED AIR FOAM MATTRESS

CROSS-REFERENCE TO RELATED APPLICATIONS

The present application claims priority of U.S. Provisional Patent Application No. 60/248,119, filed on Oct. 2, 2009 and incorporated herein by reference in its entirety.

BACKGROUND OF THE INVENTION

The present invention relates generally to air pressurized patient support mattress systems for use on hospital beds. More specifically, the present invention relates to segmented air foam mattresses having foam encapsulated by inflatable air cells.

Foam patient support systems comprise foam foundations having a recessed portion, a foam core of different compressive strength adapted to fit into the recessed portion of the foam foundation, a foam top upon which the patient ultimately rests, and a cover that wraps the top component and the perimeter of the foundation component. In various configurations, the foam core comprises a plurality of inflatable air cells that may be trapezoidal or rectangular in shape based on the configuration of the recessed portion of the foundation component. The foregoing systems have the disadvantage of limited flexibility when the bed is articulated from a flat or plane position to a reclining or seated position. Further, many patient support systems utilize a separate perimeter component, which is expensive, complicates the structure of the support system, and required higher air cell operating pressures.

Accordingly, it is desirable to provide an air foam mattress system that will maintain maximum patient comfort in all articulated bed positions.

BRIEF SUMMARY OF THE INVENTION

The present invention provides an air foam mattress system including a plurality of juxtaposed, individually-wrapped, inflatable air cells extending along a width of said system to form a segmented perimeter, the system having no solid, continuous perimeter.

In another embodiment of the invention, the inflatable air cells are held in juxtaposition by a fabric cover operable to provide a plurality of pivot lines between the air cells.

In still another embodiment of the invention, the fabric cover comprises a plurality of sleeves for receiving the inflatable air cells.

In accordance with an embodiment of the present invention suitable for use on beds having deck side walls that taper inward from top to bottom, the at least one air cell segment includes an envelope capable of containing pressurized air and a trapezoidal shaped foam insert generally conforming to the bed deck side walls, a valve component for allowing air flow in and out of the envelope, and a fabric cover containing sleeves in which the air foam segments can be retained to establish the desired foundation component length.

In accordance with another embodiment of the present invention, the foam insert includes a narrow block of foam of sufficient length to fit across the width of the bed deck, with ends tapered from top to bottom to define a trapezoidal shape, wherein the trapezoidal foam block comprises five sections joined together, including two triangular end of relatively stiff foam, a top piece of soft foam, a middle piece of moderately stiff foam, and a bottom piece of stiffer foam joined between the two triangular end pieces.

In accordance with another embodiment of the present invention, the at least one air cell segment includes an envelope capable of containing pressurized air and a U-shaped foam base insert conforming to the bed deck side walls, a valve component for allowing air flow in and out of the envelope, an I-beam component welded to the inner sides of the envelope and extending through the inner length of the envelope between the raised ends of the foam base insert. In an embodiment, the foam base insert has parallel ends extending upwardly from the bottom section, and the at least one air cell segment is joined together by snap fasteners. In another embodiment, the foam base insert has parallel ends extending upwardly without a bottom section.

BRIEF DESCRIPTION OF THE DRAWINGS

Further features of the present invention will become apparent to those skilled in the art to which the present invention relates from reading the following description with reference to the accompanying drawing figures, in which.

DETAILED DESCRIPTION OF THE INVENTION

Figure 1:
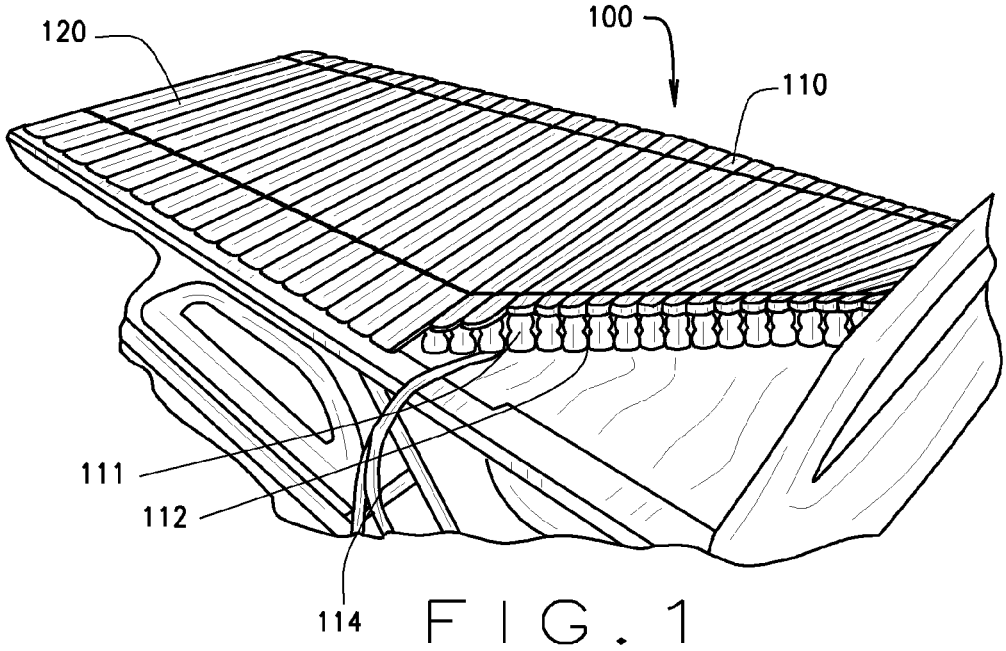
FIG. 1 is a perspective view illustrating a foundation assembly of segmented air cells according to one embodiment of the invention and having a foam top removed.

The invention will now be described with reference to the Figures, in which like reference numerals refer to like parts throughout. For purposes of clarity in illustrating the characteristics of the present invention, proportional relationships of the elements have not been maintained in the Figures. Instead, the sizes of certain components have been exaggerated for illustration.

Figure 2:
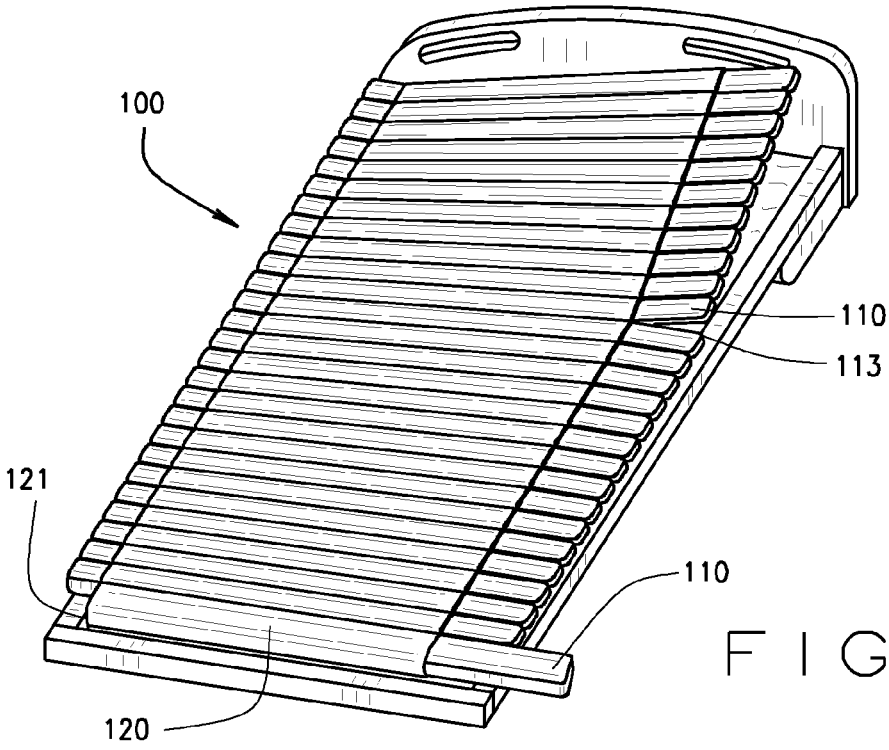
FIG. 2 is a top perspective view of the foundation assembly of segmented air cells according to one embodiment of the invention and having a foam top removed.
Figure 3:
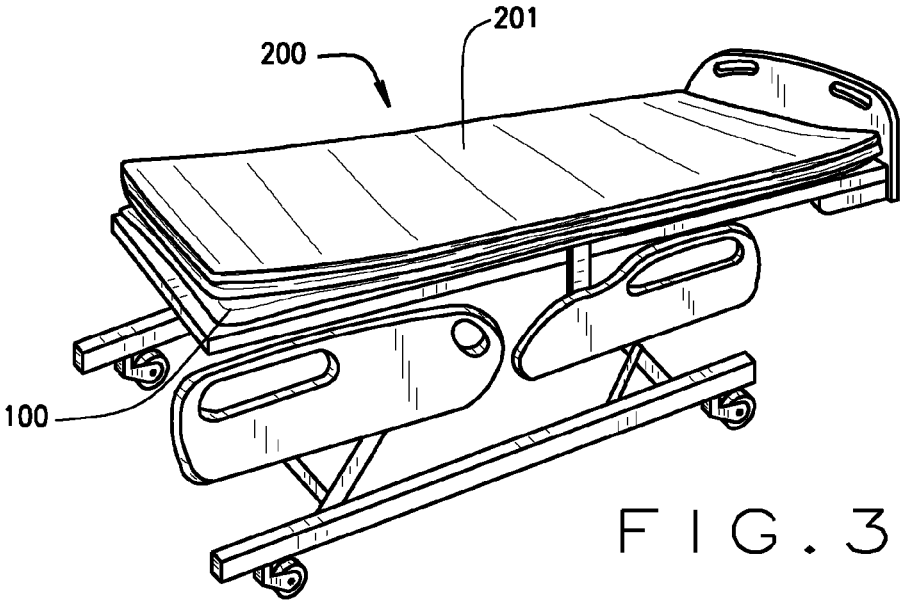
FIG. 3 is a side perspective view of an air foam mattress system according to an embodiment of the invention and having a foam top in place.

An embodiment in accordance with the present invention, as illustrated in FIGS. 1 through 4, provides an air foam mattress system suitable for use on articulating and flat hospital beds having deck side walls that taper inward from top to bottom and a variable width foundation assembly 100 including a plurality of segmented, individually wrapped, inflatable air cells 110 allowing for a plurality of pivot lines 113 between each juxtaposed cell, and individual pressure adjustment of the air cell segments for maximum patient comfort in all articulated bed positions. Referring to FIG. 3, in some embodiments, a foam top component 200 is included and contained within a fabric cover 201.

Figure 4A:
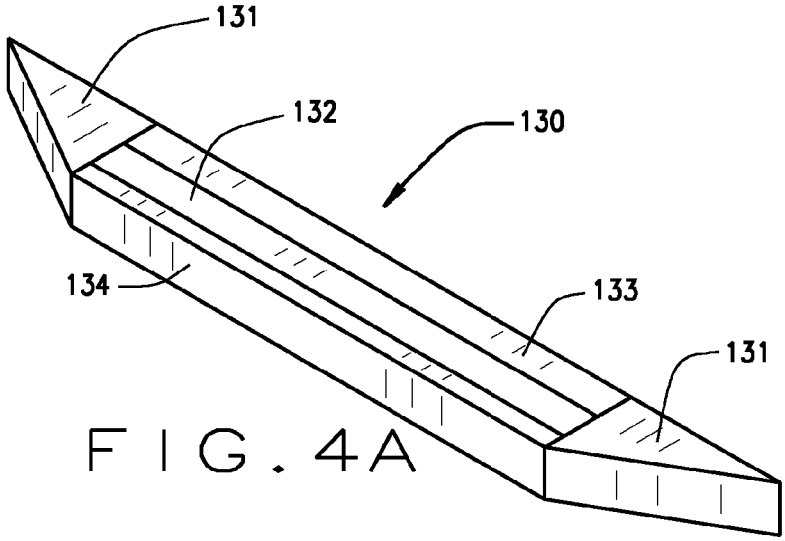
FIG. 4A is a perspective view of a foam core component according to an embodiment of the invention.
Figure 4B:
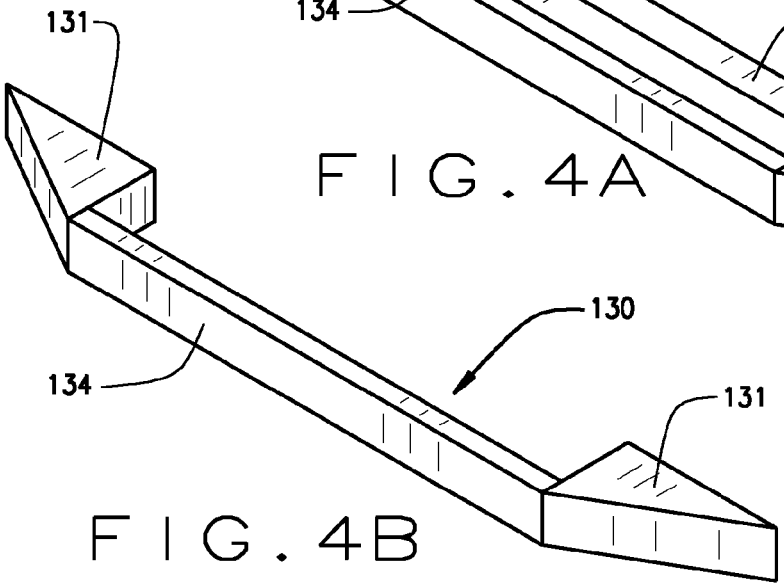
FIG. 4B is a perspective view of another embodiment of a foam core component according to an embodiment of the invention.

An embodiment of the foundation assembly 100 of the present invention is illustrated in FIG. 1 and FIG. 2, wherein a plurality of air cell segments 110 comprise a trapezoidal envelope 111 capable of containing pressurized air and a trapezoidal shaped foam insert 130 (FIG. 4A) conforming to the bed deck side walls, an air valve member 112 (see also FIG. 8C) for allowing air flow in and out of the envelope through air hose 114, and an articulating fabric cover 120 containing a plurality of sleeves 121 in which the air cell segments 110 are retained to establish the desired length and width of the foundation assembly 100 of the patient support system. Another embodiment of the trapezoidal shaped foam insert 130 is shown in FIG. 4B, where the middle 132 and top piece 133 are removed from the foam insert. The foam cells extend the width of the system and the fabric cover 120 articulates across its full width, and that the foundation assembly 100 (mattress) has a pivot line 113 across substantially the entire width of the assembly 100 and between each cell of the assembly without interference of a solid, continuous, perimeter member. FIG. 2 illustrates an air cell segment 110 partially inserted into sleeve 121 of cover 120. As further shown in FIG. 2, the seams between sleeves 121 of cover 120 form a plurality of pivot points 113 allowing air cell segments 110 to freely pivot to accommodate all articulated bed positions without bunching or being distorted.

In accordance with one embodiment of the present invention, the foam insert 130 comprises a narrow block of foam of sufficient length to fit across the width of the bed deck, with end sections 131 tapered from top to bottom to define a trapezoidal shape, wherein the trapezoidal shaped foam insert 130 comprises five sections joined together, including two triangular end pieces 131, being the stiffest foam, a top piece 133 of the softest foam, a bottom piece 134 of the second stiffest foam, such that it is softer than the end pieces 133 but harder than the top 133 and middle 132, and the middle or core piece 132 being a relatively soft foam that is stiffer than the top piece 133 but softer than the end pieces 131 and bottom piece 134. In an embodiment, the top piece 133 is therapeutic foam. Thus, with the multiple segments of the foam support insert having varied degrees of stiffness with the stiffest members being the end pieces 131, the patient is biased toward the center of the mattress creating a softer system. Further, the end pieces 136, together form a segmented perimeter section providing the desired pivoting along the entire width of the system because there is no continuous perimeter. Thus, the segmented perimeter section is integrated into the insert and held inside the air cells. Further, without the continuous perimeter which underlies the air cells, the actual air cell height is increased, which in turn permits the use of a lower pressure in the air cells. Therefore, the integrated perimeter eliminates the underlying foam making the mattress operate more therapeutically because a lower pressure is used in the increased cell height.

Figure 5:
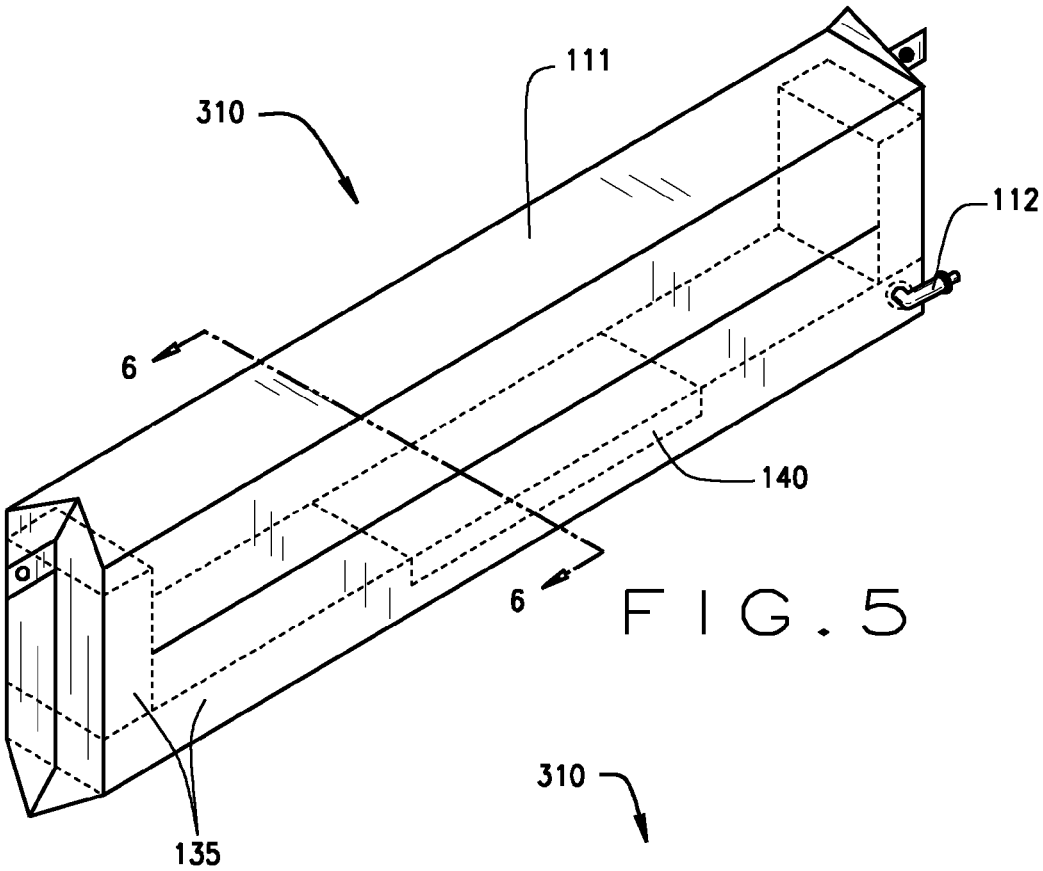
FIG. 5 illustrates a perspective view of an air cell segment, segmented from the whole mattress, according to an alternate embodiment of the invention.
Figure 6:
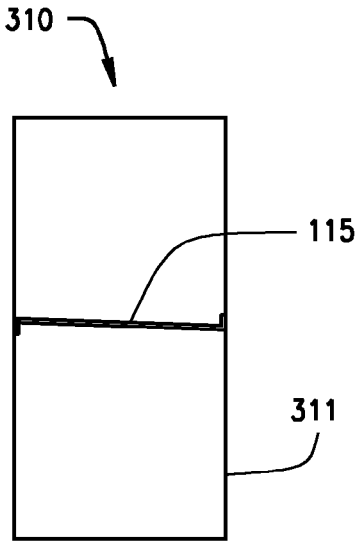
FIG. 6 is a cross-sectional view of the air cell segment shown in FIG. 5 taken along line 6-6 of FIG. 5.
Figure 7A:
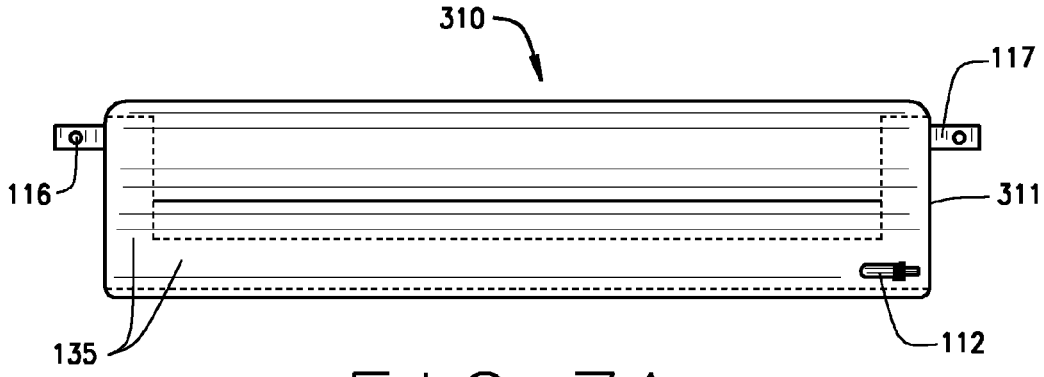
FIG. 7A illustrates a side view of the air cell segment shown in FIG. 5.
Figure 7C:
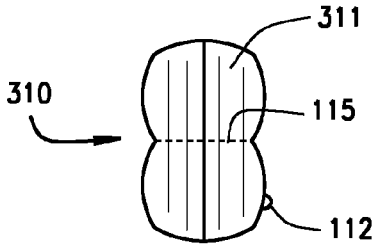
FIG. 7C illustrates an end view of an air cell segment of FIG. 7A.
Figure 8A:
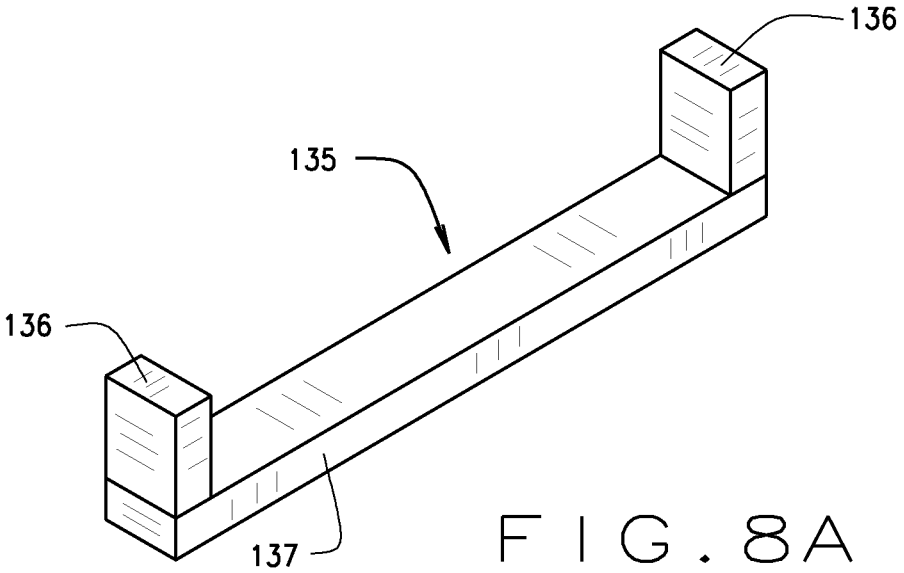
FIG. 8A is a perspective view of the foam base insert of the air cell segment shown in FIG. 5.

In accordance with another embodiment of the invention as shown in FIG. 5 and FIG. 7A, the air cell segments 310 comprise a rectangular envelope 311 capable of containing pressurized air and a U-shaped foam base insert 135 shaped to conform to the rectangular bed deck side walls, an air valve member 112 for allowing air flow in and out of the envelope, an inner I-beam element 115 welded to the inner sides of envelope 311 and extending through the inner length of the envelope between the raised ends 136 of the foam base insert 135 to maintain the shape of the air cell segment 310 and provide side support for the system. Referring to FIG. 8A, in one embodiment, the foam base insert has parallel ends 136 extending upwardly from a bottom section 137, and an adhesive used to join the bottom section 137 to the ends 136. Alternatively, the U-shaped piece is formed unitarily. Referring to FIG. 8D, in another embodiment, the foam base insert 137 includes only parallel ends 136. In one embodiment, an adhesive is used to hold the parallel ends in place within the air cell segment. In another embodiment, a thermal bond holds the parallel ends in place within the air cell segment. The ends 136 together form a segmented perimeter with increased stiffness making patient transfers onto and off the mattress much safer. In another embodiment, the u-shaped insert 135 includes a central foam panel 140 of softer or therapeutic foam extending over a central portion of the length of the insert 135 and to a desired depth of approximately one-half of the thickness of the bottom section 137. The air cell segments 310 are joined together by snap fasteners 117. An embodiment of air valve member 112 is shown attached to envelope 311 in FIG. 8C. An end view of an air cell segment 310 according to an embodiment of the invention is shown in FIG. 7C.

Figure 7B:
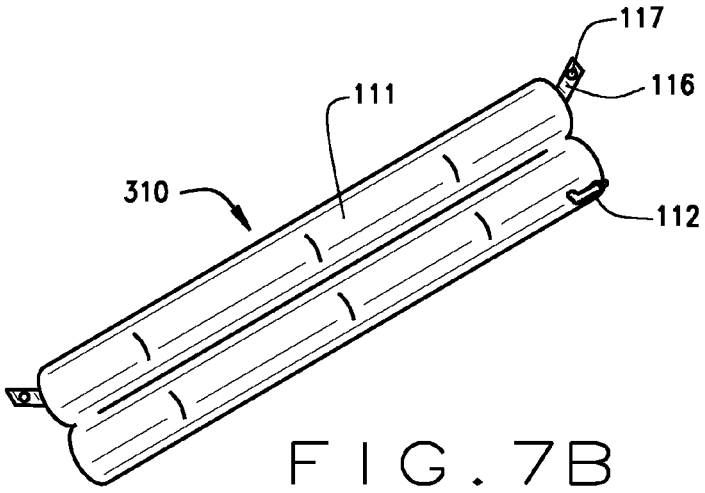
FIG. 7B illustrates a perspective view of the air cell segment of FIG. 7A.
Figure 8B:
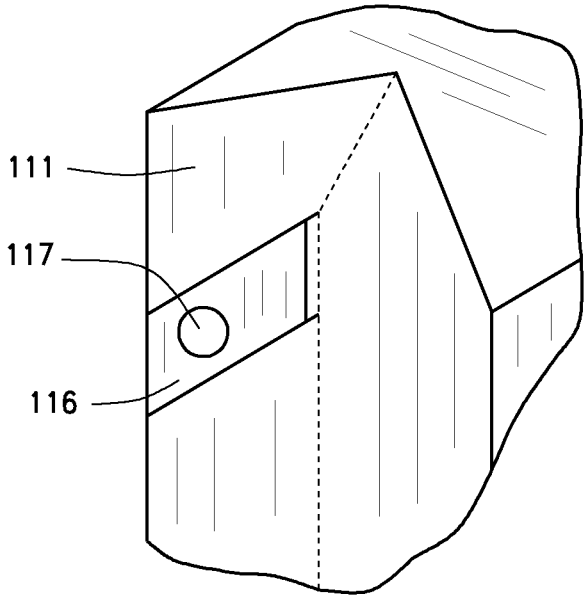
FIG. 8B is a perspective fragmentary view of the snap assembly of the air cell segment shown in FIG. 7A.
Figure 8C:
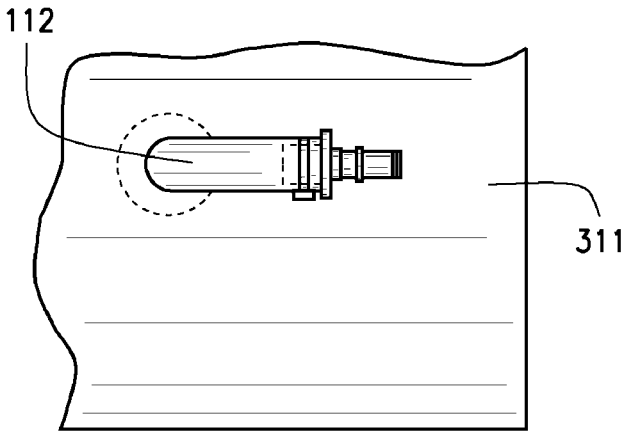
FIG. 8C is an elevated fragmentary view of the air valve of the air cell segment according to an embodiment of the invention.
Figure 8D:
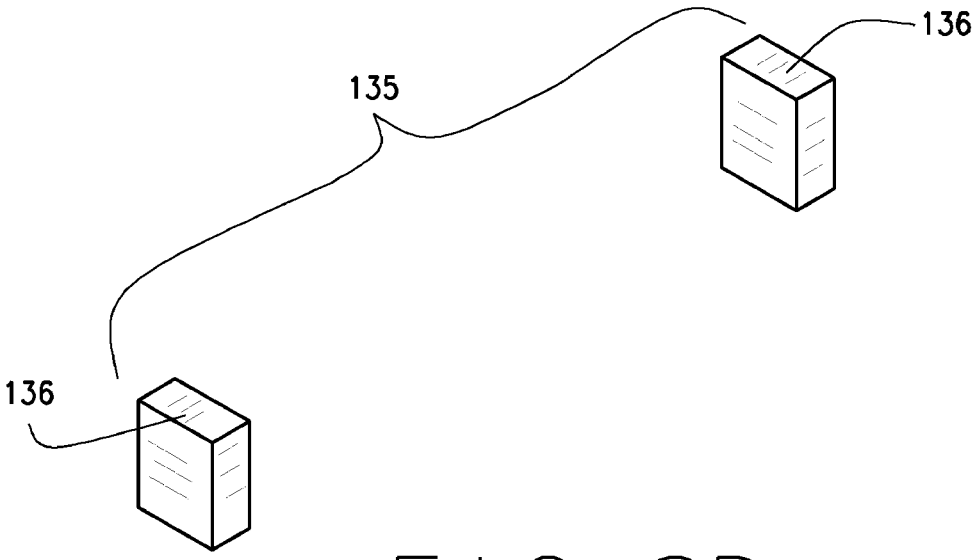
FIG. 8D is a perspective view of another embodiment of the foam base insert of the air cell segment shown in FIG. 5.

In accordance with an embodiment as shown in FIG. 7B and FIG. 8B, the air cell envelope 311 further includes a strap element 116 attached to each end face of the air cell envelope 311, and a snap fastener 117 attached to each strap element 116 to provide an alternative manner by which the air cell segments 110 are joined together with a wrap (not shown) adapted with a plurality of receiving snap members to form the rectangular foundation assembly.

Figure 9A:
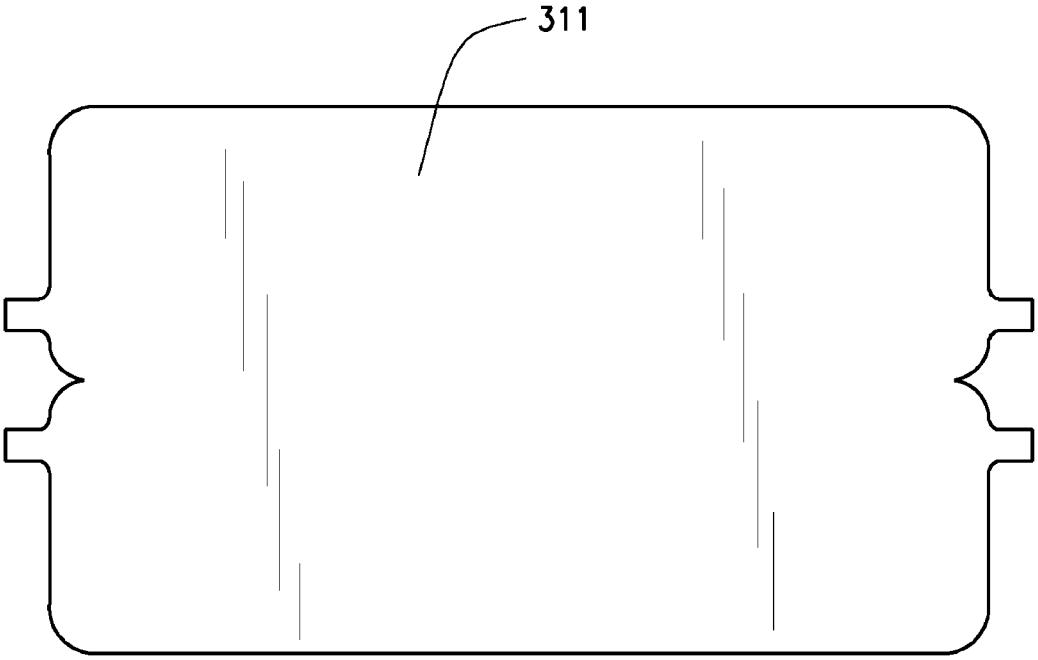
FIG. 9A illustrates the cut sheet for the envelope of an air cell according to an embodiment of the invention.
Figure 9B:
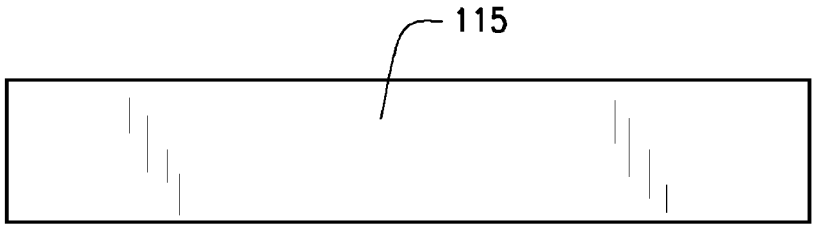
FIG. 9B illustrates the cut sheet for the inner connecting beam of an air cell according to an embodiment of the invention.

FIG. 9A illustrates a cut sheet of air impermeable material used to fabricate an air cell envelope 111 according to an embodiment of the invention. FIG. 9B illustrates a top view of the inner I-beam element 115 according to an embodiment of the invention.

Accordingly, it is an object of the present invention to provide an improved air foam mattress system for hospital beds. There has, thus, been described certain embodiments of the invention in order that the invention may be better understood, and in order that the present contribution to the art may be better appreciated. Further, since numerous modifications and variations will readily occur to those skilled in the art, it is not desired to limit the invention to the exact construction and operation illustrated and described, and accordingly, all suitable modifications and equivalents may be resorted to and fall within the scope of the invention.

The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for designing other structures, methods, and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

The invention claimed is:

1. An air foam mattress system comprising:

a plurality of juxtaposed, individually-wrapped, inflatable air cells extending along a width of said system to form a segmented perimeter, the system having no solid, continuous perimeter; and a plurality of trapezoidal inserts operable to substantially fit within each air cell, each trapezoidal insert comprising:

a bottom piece extending between a first triangular end piece and a second triangular end piece, wherein the first and second triangular end pieces taper from a thin outward perimeter edge portion to a thick inward portion;

wherein the bottom piece, and first and second end pieces, are manufactured from foam; and wherein the first and second end pieces are stiffer than the bottom piece.

2. The air foam mattress system of claim 1, wherein the inflatable air cells are held in juxtaposition by a fabric cover operable to provide a plurality of pivot lines between the air cells.

3. The air foam mattress system of claim 2, wherein the fabric cover comprises a plurality of sleeves for receiving the inflatable air cells.

4. The air foam mattress system of claim 1, further comprising individual pressure adjustment for at least one of the plurality of air cells.

5. The system according to claim 1 wherein each trapezoidal insert further comprises a middle piece disposed above the bottom piece extending between the first triangular end piece and the second triangular end piece.

6. The system according to claim 5, wherein each trapezoidal insert further comprises a top piece disposed above the middle piece extending between the first triangular end piece and the second triangular end piece.

7. The system according to claim 6, wherein:

the middle piece is manufactured from foam;

the top piece is manufactured from foam;

the middle piece is stiffer than the top piece; and the middle piece is softer than the first and second end pieces.

8. An air foam mattress system for a rectangular bed deck having side walls, the system comprising:

a plurality of juxtaposed, individually-wrapped, inflatable air cells extending along a width of the system to form a segmented perimeter, the system having no solid, continuous perimeter;

a U-shaped insert operable to substantially fit within each air cell and conform to the bed deck side walls, each insert comprising:

a base extending between a first raised end piece and a second raised end piece, wherein the base is manufactured from foam; and wherein the base further includes a central foam panel, and the central foam panel is softer than the base;

an air valve member operable to allow air flow in and out of the air cell; and an I-beam element attachably connected to inner sides of the air cell and extending through an inner length of the air cell between the raised end pieces.

* * * * *